US007281591B2

(12) United States Patent
Bone

(10) Patent No.: US 7,281,591 B2
(45) Date of Patent: Oct. 16, 2007

(54) ELECTRICAL CONNECTION FOR A POWER TOOL

(75) Inventor: Gareth Bone, Tudhoe (GB)

(73) Assignee: Black & Decker Inc., Newark, DE (US)

( * ) Notice: Subject to any disclaimer, the term of this patent is extended or adjusted under 35 U.S.C. 154(b) by 817 days.

(21) Appl. No.: 10/289,877

(22) Filed: Nov. 7, 2002

(65) Prior Publication Data

US 2006/0086517 A1 Apr. 27, 2006

(30) Foreign Application Priority Data

Nov. 20, 2001 (GB) ..... 0127825.8

(51) Int. Cl.
*E21B 3/00* (2006.01)

(52) U.S. Cl. ..... 173/217; 173/170; 173/171; 173/42; 310/50

(58) Field of Classification Search ..... 173/216, 173/217, 170, 171, 42; 310/50; 81/177.7
See application file for complete search history.

(56) References Cited

U.S. PATENT DOCUMENTS

| | | | | |
|---|---|---|---|---|
| 3,955,240 | A | 5/1976 | Schuh et al. | |
| 4,347,450 | A * | 8/1982 | Colligan | 310/50 |
| 4,522,270 | A * | 6/1985 | Kishi | 173/217 |
| 4,645,371 | A | 2/1987 | Wang | |
| 4,912,349 | A | 3/1990 | Chang | |
| 5,022,118 | A | 6/1991 | Wan-Li | |
| 5,149,230 | A | 9/1992 | Nett | |
| 5,161,293 | A | 11/1992 | Ebbert | |
| 5,681,214 | A | 10/1997 | Kleider et al. | |
| 5,816,614 | A | 10/1998 | Kramer, Jr. et al. | |
| 6,102,134 | A * | 8/2000 | Alsruhe | 173/217 |
| D443,491 | S | 6/2001 | Robson | |
| D447,924 | S | 9/2001 | Neitzell et al. | |
| 6,321,856 | B1 * | 11/2001 | Alsruhe | 173/217 |
| 6,364,033 | B1 * | 4/2002 | Hung et al. | 173/217 |
| D475,907 | S * | 6/2003 | Neitzell et al. | D8/61 |
| D476,542 | S * | 7/2003 | Chunn et al. | D8/61 |
| 6,938,706 | B2 * | 9/2005 | Ng | 173/216 |
| 2003/0095842 | A1 * | 5/2003 | Bone | 408/234 |

FOREIGN PATENT DOCUMENTS

| | | |
|---|---|---|
| DE | 8505814 | 5/1985 |
| DE | 3542637 | 6/1987 |
| DE | 9309682 | 10/1993 |
| DE | 19629902 | 1/1998 |
| DE | 29809044 | 10/1998 |
| EP | 0993 909 A | 4/2000 |
| EP | 1 059 025 A | 12/2000 |

* cited by examiner

*Primary Examiner*—John Sipos
*Assistant Examiner*—Michelle Lopez
(74) *Attorney, Agent, or Firm*—Harness, Dickey & Pierce, P.L.C.

(57) ABSTRACT

A power tool (2) has a handle (6) and a tool body (4) pivotably coupled to the handle (6) by a pivot (76, 78, 102, 104). A motor (16), mechanically coupled to a rotary output (20), is housed in the tool body (4). A trigger switch (32) is housed in the handle (6). A locking mechanism is coupled with the handle and tool body. The locking mechanism enables or prevents pivotal movement of the tool body (4) relative to the handle (6). An electrical connection (36,38) between the handle (6) and the tool body (4) passes through the pivot (76,78,102,104).

18 Claims, 13 Drawing Sheets

122
10
116
114
118
74
100
104
82
88
20
28
14
34
39
24
44
40
30
22
16
36
38
42
32
12
80
76
98
102
8

ELECTRICAL CONNECTION FOR A POWER TOOL

The present invention relates to power tools and, in particular, to electric drills comprising a handle and a pivotable drill head having an electrical connection between the handle and the drill head.

Electric drills and electric screwdrivers are well known in the art. Attempts have been made to combine an electric drill with an electric screwdriver, resulting in a power tool resembling a conventional electric drill with added features to enable slow and controlled screw driving speeds. One such power tool, referred to as a drill-driver, is shown in FIG. 1. This drill-driver comprises a body having a drill head portion and a handle portion fixed at approximately right angle to the drill head portion. The drill head portion encapsulates an electric motor and a gearbox and the handle portion defines a conventional pistol grip to be grasped by the user. The handle portion comprises a variable speed trigger switch for low-speed rotary output in screw driving mode or high-speed rotary output in drilling mode. Conventional electrical wires make the electrical connection between the trigger switch in the handle portion and the motor in the head portion. The electrical wires are housed safely within the body and may be copper wires insulated in a plastic sheath. This drill-driver is well suited to drilling and screw driving, provided that the workpiece is easily accessible. However, if the hole to be drilled, or the screw to be fastened, is in a tight corner or an awkward position then this drill-driver, like a conventional electric drill, cannot gain access. In this case the user will need to resort to a smaller hand operated drill or a hand held screwdriver perform the task in hand.

Attempts have also been made to improve utilage of such drill-drivers and to provide solutions to the above problems by inclusion of a pivotable drill head portion, which enables the configuration of the drill-driver to be adapted according to the task in hand. An example of this is seen in German Utility Model 8505814.9, which discloses an electric drill having a drill head and a handle. The drill head comprises an electric motor coupled to a gearbox. The gearbox includes a rotary output protruding from the front end of the drill head. The handle comprises an on/off trigger switch and a battery pack. A flange extension attached to the rear end of the drill head is pivotally coupled to the top end of the handle. The drill head can be pivotally adjusted with respect to the handle through an arc of 90°, between a position where the drill head is perpendicular to the handle and another position where the drill head is in-line with the handle. By enabling pivotal rotation of the drill head relative to the handle the drill-driver disclosed by German Utility Model 8505814.9 is able to access work pieces inaccessible to a conventional drill-driver with pistol grip, like that shown in FIG. 1. However, the pivotal rotation between the drill head and the handle produces a new problem of how to provide a simple and effective electrical connection between the drill head and the handle.

It is an object of the present invention to provide a power tool of type described at the outset, in which the advantages of pivotal movement between the drill head and the handle are preserved, whilst providing a simple and effective electrical connection between the drill head and the handle.

Accordingly there is provided a power tool comprising a handle and a tool body pivotally coupled to the handle by a pivot, characterized in that an electrical connection between the handle and the tool body passes through the pivot. The electrical connection may be, for example, by metal strips in frictional contact with metal slip rings or by conventional electric wires. The pivot may be any one of a range of known pivot mechanisms like, for example, a hinge, a spindle supported by ball bearings or a hub supported by a yoke, provided the pivot has enough space to accommodate the electrical connection. The pivot is a convenient location for the passage of the electrical connection from the handle to the tool body because the pivot is an existing link between the handle and the tool body. This obviates the need of an additional link between the handle and the tool head to accommodate the electrical connection.

Preferably the pivot has a first axis and a connection aperture substantially concentric with the first axis, wherein the electrical connection passes though the connection aperture. A connection aperture located substantially concentric with the first axis of the pivot provides a convenient passage for the electrical connection because relative movement between the pivoting drill head and handle is minimal at the axis of the pivot.

Preferably the electrical connection comprises two electrical wires. Electrical wires have the advantage of being more flexible than metal strips and therefore less liable to breakage, and are insulated. Location of the connection aperture in the first hub is concentric with the first axis, which has the advantage that the wires are only lightly twisted as the tool head pivots relative to the handle and, as such, the wires are not subject to significant wear and tear. Using wires to electrically couple the components located in the handle with those located in the tool head obviates the need to implement the more elaborate and expensive solution of using metal strips with metal slip rings at the pivot.

Preferably, if a gap between the two electrical wires and the connection aperture is present then this gap should be sealed in order to shield the internal components of the tool body from ingress of dust and dirt.

Preferably the pivot comprises at least one circular aperture formed in one of the tool body or the handle and at least one cylindrical hub protruding from the other of the tool body or the handle, wherein the at least one aperture has the first axis. The at least one hub is disposed concentrically within a respective aperture. Preferably the outer diameter of the at least one hub is slightly smaller than the diameter of a respective aperture to allow for sliding contact there between. Sliding contact between the at least one hub and a respective aperture supports the tool head for pivotal rotation relative to the handle. This pivot is a simple arrangement and, as would be apparent to the person skilled in the art, the pivot could function correctly whether the hub is disposed upon the tool head and the aperture is formed in the handle, or vice versa.

Preferably, the at least one aperture is formed in the handle and the at least one hub is disposed upon the tool body. By forming the aperture in the handle, instead of the tool body, the number of holes in the tool body is reduced. This reduces the locations where dust and dirt may enter the interior of the tool body and interfere with the components, such as the motor, enclosed therein. Minimising the number of holes formed in the tool body has the advantage of increasing shielding of the interior components.

More preferably, the at least one aperture comprises a first aperture and a second aperture wherein the first aperture and the second aperture each have the first axis, and the at least one hub comprises a first hub disposed within the first aperture and a second hub disposed within the second aperture. In this case, the pivot comprises two hub and aperture arrangements, one of each arrangement disposed on diametrically opposite sides of the tool head to provide additional strength and rigidity to the pivotal support of the tool head. Preferably, the connection aperture is in the first hub.

Preferably, the tool body is elongate and has a second axis perpendicular to the first axis and the power tool comprises a motor coupled to a rotary output, wherein the rotary output has the second axis. In this case, the rotary output conveniently protrudes from one of the ends of the elongate tool body.

Preferably, the motor is housed in the tool body, rather than the handle. This avoids the need for a complex mechanical coupling between the motor located in the handle and the rotary output located in the tool body.

Preferably, the power tool further comprises a power source for energizing the motor and an electrical switch electrically coupled to the power source, wherein the switch is disposed upon the handle and the electrical connection carries electrical current from the switch to the motor housed in the tool body. In this case, the user can hold the power tool by the handle with one hand and operate the switch at the same time.

To make the power tool more portable the power source is preferably a battery pack. Depending on the intended work environment of the power tool, the battery pack may be housed within the handle or detachably connected to the handle.

A battery pack housed within the handle may be electrically coupled to an electrical socket disposed upon the handle. The electrical socket connects the battery pack to an external battery-charging source.

To facilitate the grasp of the user's hand the handle may be elongate and has a third axis. The third axis is perpendicular to the first axis.

An arc defined by pivotal rotation of the tool head relative to the handle about the first axis subtends a pivotal angle between the second axis and the third axis. If the pivotal angle is limited to 90° then the tool head can only pivot between two operating positions located at right angle to each other, like, for example:

the tool head orientated approximately at right-angle to the handle and pointing ahead of the handle; and the tool head orientated approximately in-line with the handle.

Preferably the pivotal angle can vary within a range greater than 90° thus giving the tool head scope to pivot relative to the handle beyond the limits of operating positions i) and ii) above.

Alternatively, the pivotal angle can vary within a range of 180° thus providing another operating position, in addition to those described above, wherein:

iii) the tool head orientated approximately at right angle to the handle and pointing behind the handle.

However, the orientation of the drill head relative to the handle need not be limited to operating positions i), ii) and iii) above when pivoting within a pivotal angle range of 180°, or any other pivotal angle range, and may also include one or more other positions.

The pivotal angle may vary between 90° and 270° such that the tool head is perpendicular to the handle in positions i) and iii) above.

In addition to providing pivotal support to the tool head, the power tool preferably comprises a locking mechanism for locking the tool body against pivotal movement relative to the handle. The locking mechanism can be released to allow pivotal movement of the tool head relative to the handle when the user wishes to change the orientation of the tool head in preparation for a different task. After changing the orientation of the tool head, the user can lock the tool body in its new position by operating the locking mechanism. As would be apparent to the skilled person in the art many different and suitable types of locking mechanism are readily available like, for example, a simple nut and bolt arrangement or a magnetic lock.

A preferred embodiment of the present invention will now be described by way of example only, with reference to the accompanying illustrative drawings in which.

Figure 1:
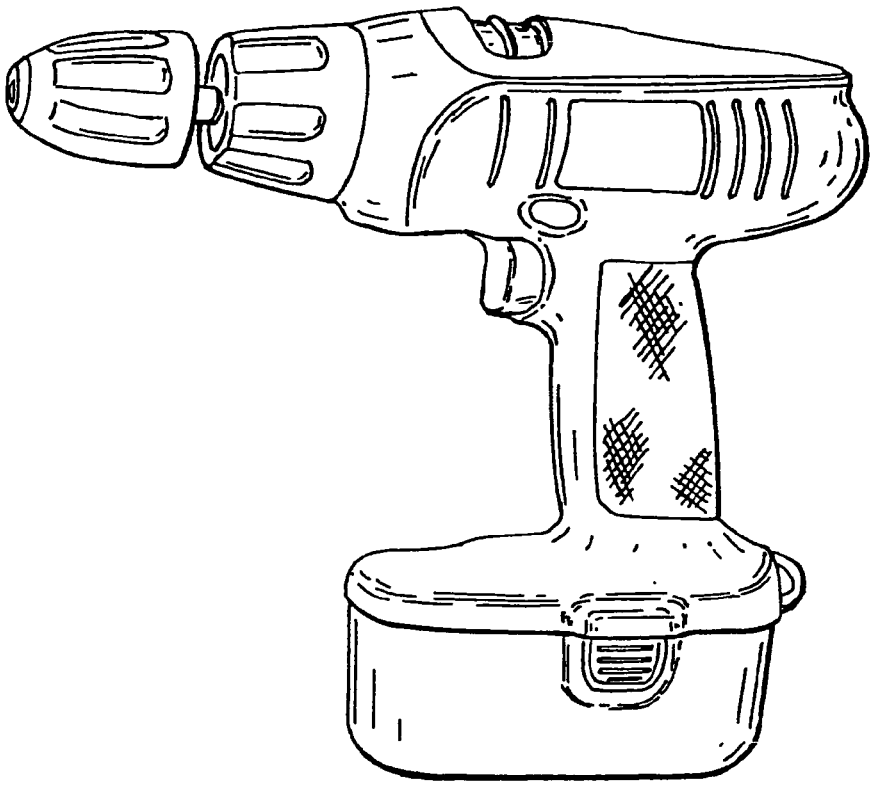
FIG. 1 PRIOR ART
FIG. 1 shows a conventional pistol grip drill-driver.
Figure 2:
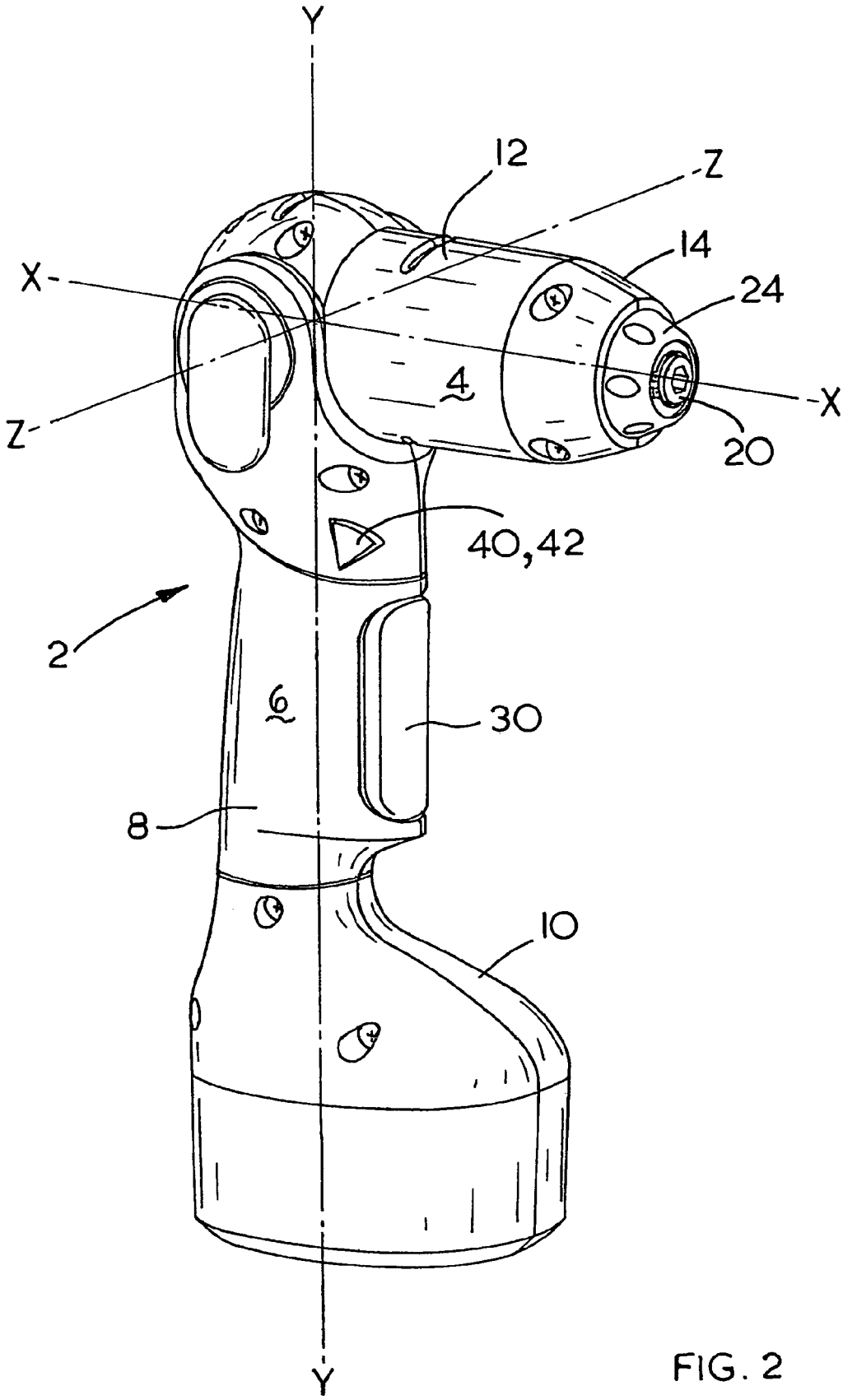
FIG. 2 shows a side perspective view of the power tool.
Figure 3:
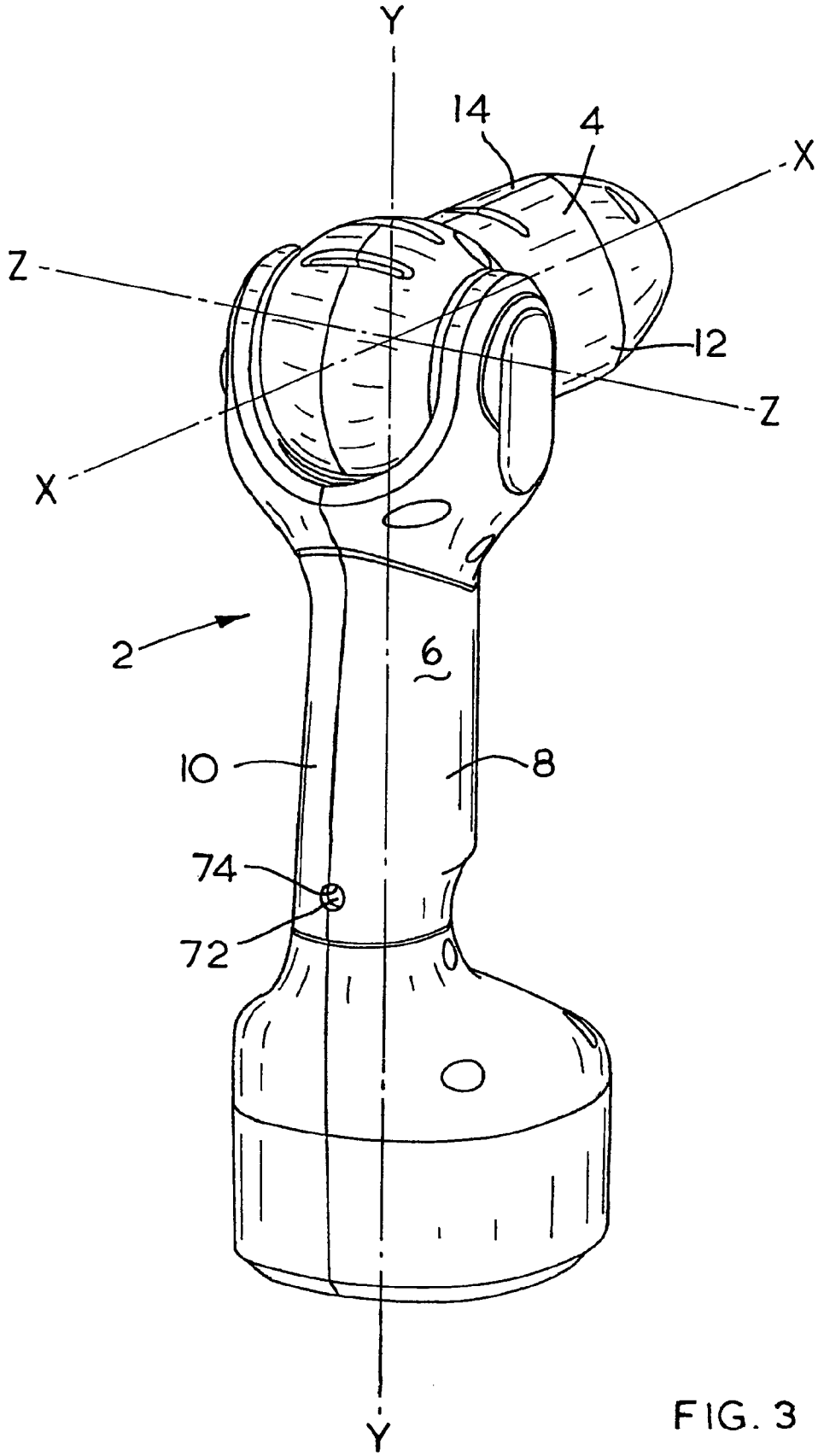
FIG. 3 shows a rear perspective view of the power tool.

Referring now to FIGS. 2 and 3, a power tool shown generally as (2) is a drill-driver comprising a substantially cylindrical drill head (4) having a longitudinal axis X and an elongate handle (6) arranged about a longitudinal axis Y. The drill head (4) is pivotally mounted upon the handle (6) and pivots relative to the handle (6) about an axis Z. The handle (6) is formed by a first clamshell (8) and a second clamshell (10) which are joined together by a plurality of screws (not shown). The drill head (4) is formed by a third clamshell (12) and a fourth clamshell (14) which are joined together by a plurality of screws (not shown).

Figure 4:
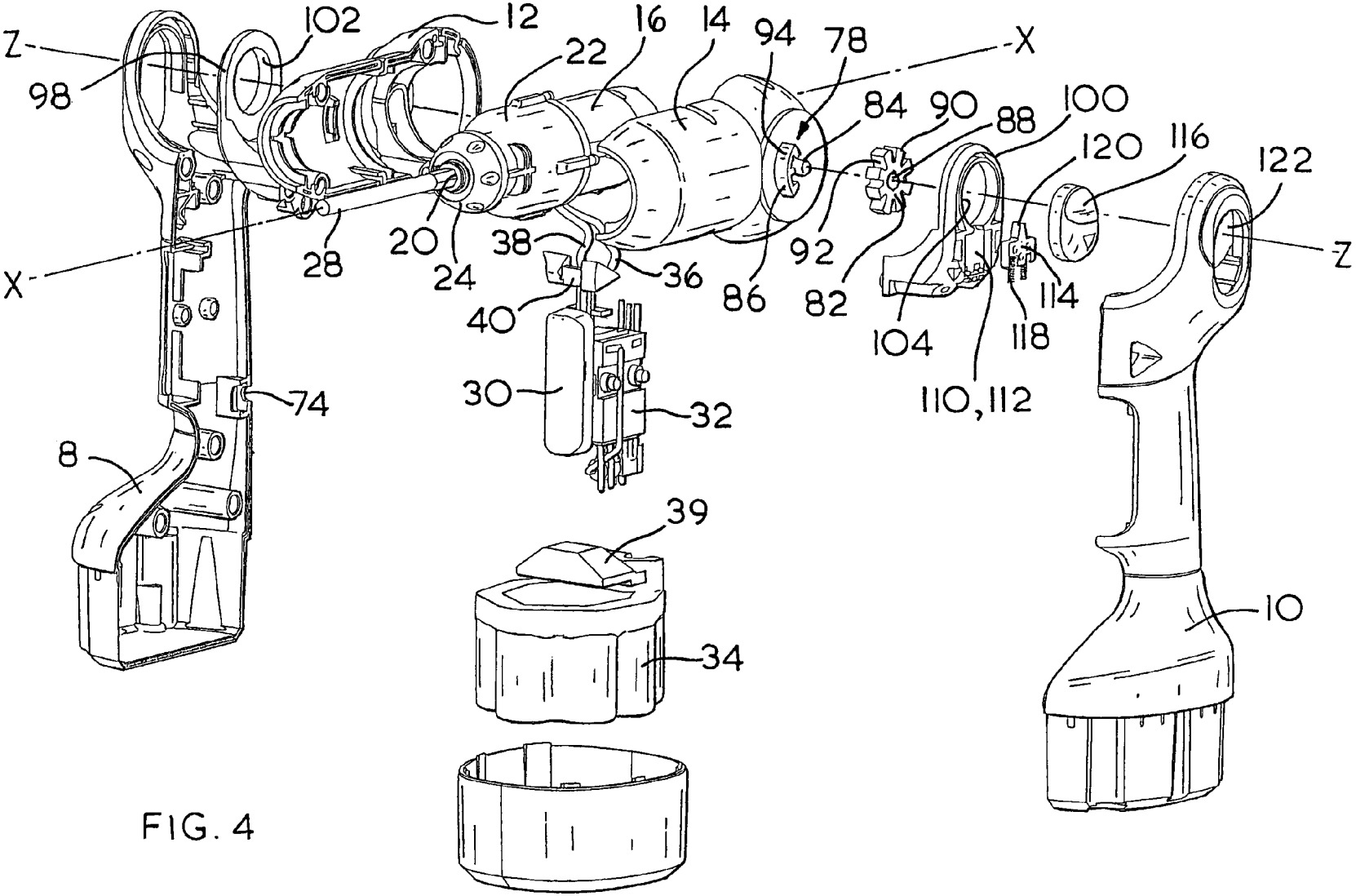
FIG. 4 shows an exploded perspective view of one side of the power tool.
Figure 5:
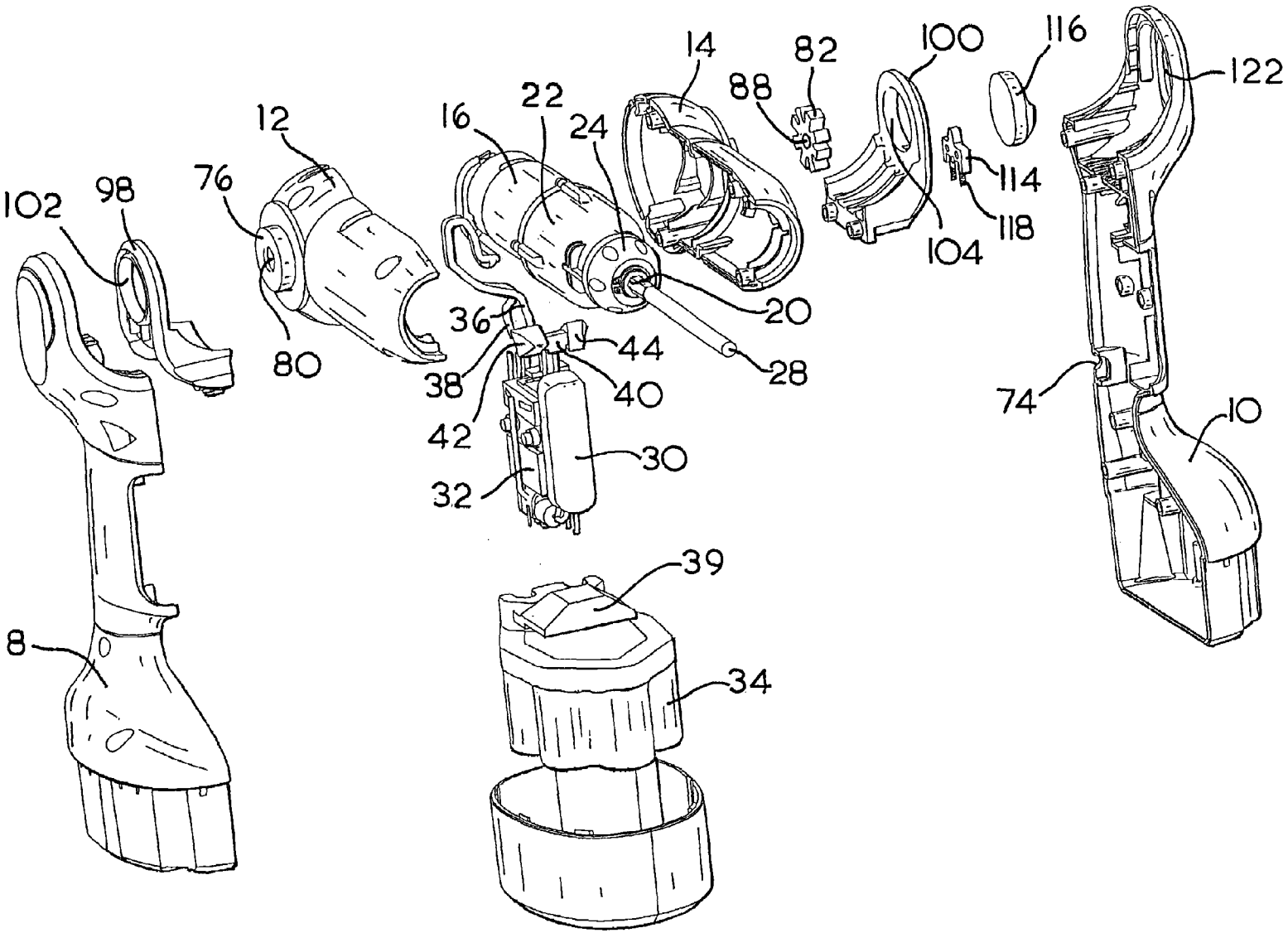
FIG. 5 shows an exploded perspective view of the other side of the power tool to that shown in FIG. 4.

Referring to FIGS. 4 and 5, the drill head (4) comprises an electric motor (16) and a transmission gearbox (not shown) with an output spindle (20). The motor (16) and the gearbox are housed inside the drill head (4). The front end of the drill head (4) comprises a cylindrical gear casing (22) surrounding the gearbox and the output spindle (20). The motor (16) is rotatingly coupled to the gearbox such that rotary motion of the motor (16) is transferred to the output spindle (20) via the gearbox. The end portion of the output spindle (20) has a hex drive coupling (24) attached thereto. The output spindle (20) and the coupling (24) protrude through a hole (26) in the gear casing (22). The output spindle (20) and the coupling (24) rotate about the axis (x). The coupling (24) releasably connects the output spindle (20) to a tool (28) having a conventional hexagonal shank arrangement. Equally, another type of coupling like, for example, a conventional chuck can be attached to the end portion of the output spindle (20) for connection to a tool (28).

The handle (8) comprises a button (30) fixed to a variable speed electrical switch (32). The switch (32)is electrically coupled to a power source (34). The switch (32) is also electrically coupled to the motor (16) by two electrical wires (36,38). The switch (32) is thermally coupled to a heat sink (39) located inside the handle (6). The heat sink (39) is for dissipating excess heat energy created by the internal components of the switch (32). The switch (32) is biased into an OFF position wherein the switch (32) interrupts electrical connection between the power source (34) and the motor (16) such that the motor (16) is denergised and the output spindle (20) does not rotate. Depression of the button (30) moves the switch (32) to an ON position wherein the switch (32) makes electrical connection between the power source (34) and the motor (16). The motor (20) is energised by the electrical current from the power source (34) and the output spindle (20) starts to rotate. Electrical current flowing from the power source (34) to the motor (16) is thus controlled by the switch (32) and is proportional to how far the button (30) is depressed. As depression of the button (30) increases so does flow of electrical current to the motor (16) causing a corresponding increase in the rotational speed of the output spindle (20), and vice versa. When the button (30) is released the switch (32) returns to the OFF position to interrupt the electrical connection between the power source (34) and the motor (16) thus causing denergision of the motor (16).

Figure 6:
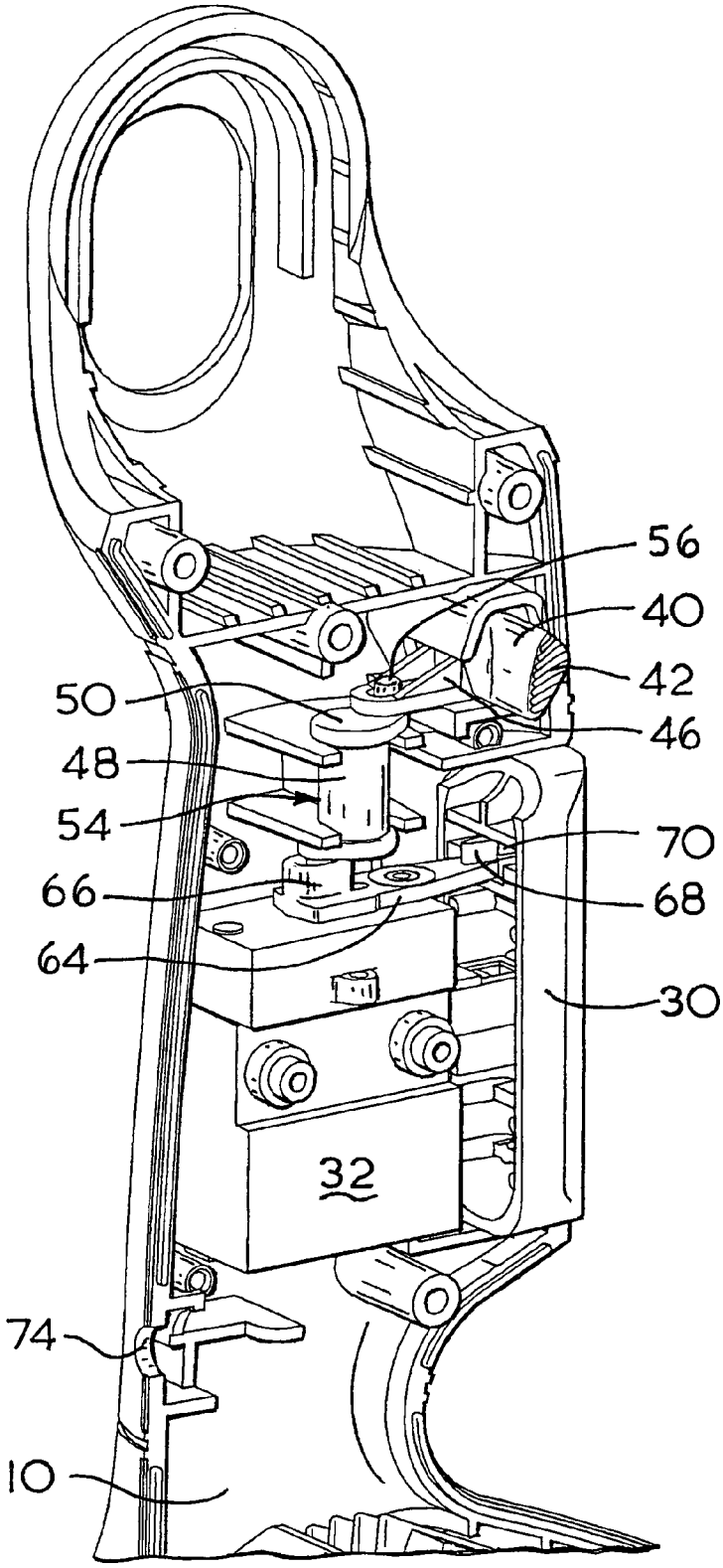
FIG. 6 shows a detailed view of the switch and the direction selector.
Figure 7:
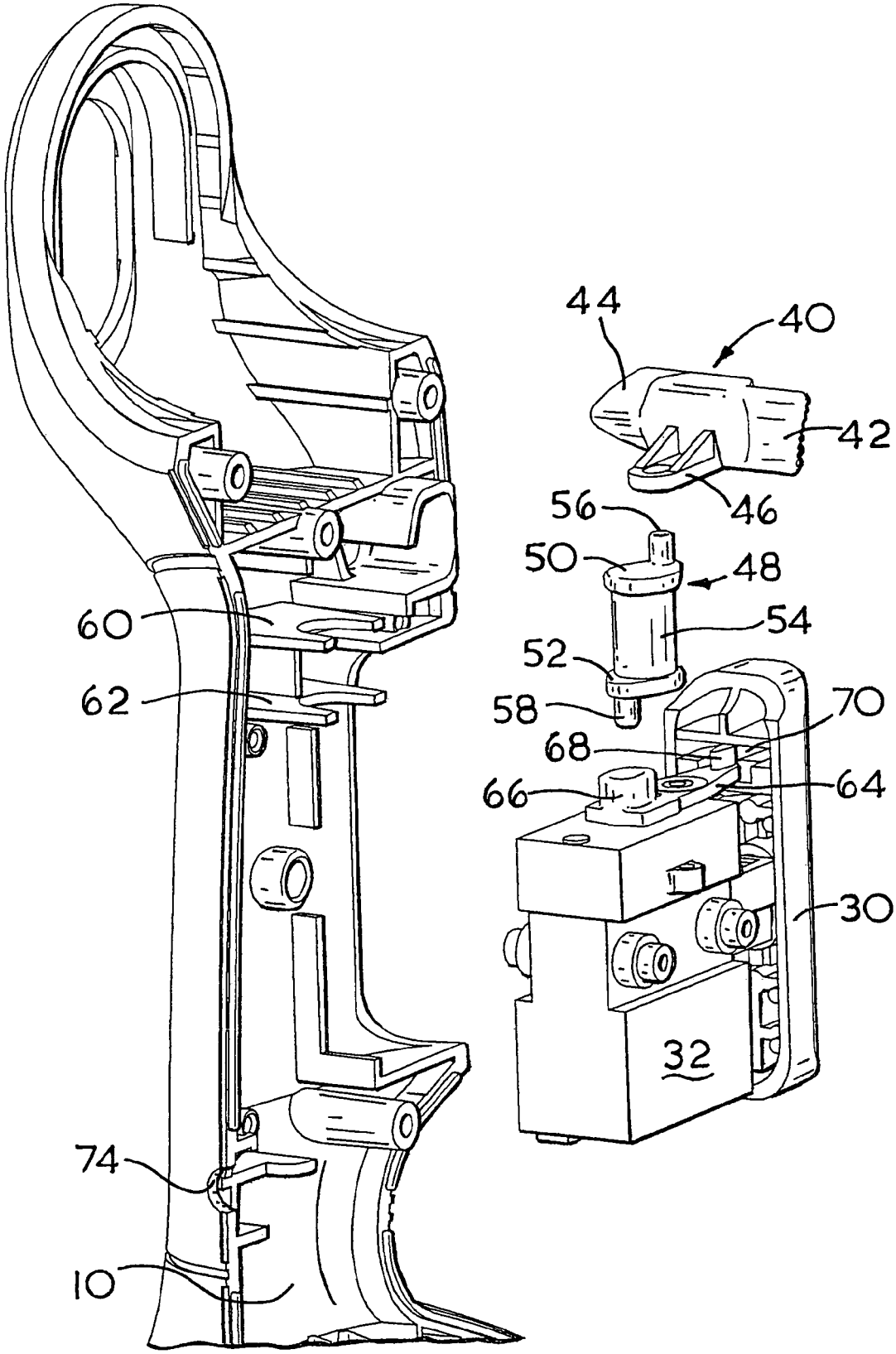
FIG. 7 shows an exploded view of the switch and the direction selector.

Referring to FIGS. 6 and 7, the handle (6) comprises a direction selector (40) for selecting the rotational direction of the motor (16) and the output spindle (20). The direction selector (40) is approximately T-shaped and comprises a forward button (42) on one side, a reverse button (44) on the other side, and a flange (46) in the middle. To support the direction selector (40) the forward (42) and reverse (44) buttons partially protrude through an aperture in each of the first (8) and second (10) clamshells respectively. The handle also comprises a barrel (48) with an upper flange (50), a lower flange (52) and a central cylinder (54) located between the upper and lower flanges (52,54). The barrel's flanges (50,52) each have a mainly circular circumference part which is interrupted by a protruding part and are shaped like a tear-drop. The circular part of upper and lower flanges (50,52) has a diameter greater than the central cylinder (54). The protruding part of the upper flange (50) has an upper spigot (56). The protruding part of the lower flange (54) has a lower spigot (58). The upper and lower spigots (56,58) are eccentric with respect the axis of the central cylinder (54) and point axially away from the central cylinder (54). The barrel (48) is supported for pivotal rotation by a pair of brackets (60,62) which are moulded into interior of the handle's clamshells (8,10). The brackets (60,62) surround the central cylinder (54) to support the barrel (48) against lateral movement. The brackets (60,62) abut the inner faces of the upper and lower flanges (50,52) to support the barrel (48) against axial movement. The handle (6) further comprises an arm (64) with a hollow cylindrical hub (66) at one end and a finger (68) at the other end. The arm (64) is pivotally coupled to the internal components of the switch (32) at a point midway between the hub (66) and the finger (68). The arm (64) can pivot between a forward position, a central position and a reverse position. Pivotal movement of the arm (64) from its forward position to its reverse position, and vice versa, causes the switch (32) to change the polarity of the electrical wires (36,38), as explained in more detail below.

The direction selector (40) is mechanically coupled to the switch (32) via the barrel (48) and the arm (64) in the following manner. The barrel's upper spigot (56) engages the direction selector (40) by protruding through a hole in the flange (46). The barrel's lower spigot (58) is seated within the arm's hollow cylindrical hub (66) in the manner of a trunnion arrangement. As such, depression of the forward button (42) slides the direction selector (40) and the upper spigot (56) in one direction thereby rotating the barrel (48) about its axis. Rotation of the barrel (48) moves the lower spigot (58) in the opposite direction thereby pivoting the arm (64) into its forward position. Depression of the reverse button (44) reverses this sequence and causes the arm (64) to pivot from its forward position to its reverse position.

When the arm (64) is in its forward position the polarity of the wires (36,38) causes the motor (16) to turn the output spindle (20) in a clockwise direction when the switch (32) is in the ON position. When the arm (64) in its reverse position the polarity of the wires (36,38) is reversed and the motor (16) to turns the output spindle (20) in an anti-clockwise direction when the switch (32) is in the ON position. When the arm (64) is in its central position the arm's finger (68) is aligned with and abuts a central stop (70) on the interior of the button (30) thereby preventing depression of the button (30) and locking the switch (32) in the OFF position.

The direction selector's buttons (42,44) are arrowhead shaped. The apex of the forward button (42) points forward to give the user a visual and tangible indication that depression of the forward button (42) causes the output spindle (20) to rotate in a clockwise direction (i.e. the rotational direction causing a screw or drill bit to be driven "forward" into a work piece) when the switch (32) is in the ON position. Conversely, the apex of the reverse button (44) points backward to give the user a visual and tangible indication that depression of the reverse button (42) causes the output spindle (20) to rotate in an anti-clockwise direction when the switch (32) is in the ON position.

The power source is a rechargeable battery pack (34) housed inside the bottom of the handle (6). To improve the electrical charge of the battery pack (34), thereby increasing operating life, the battery pack (34) is relatively bulky causing the handle (6) to protrude on the side of the switch button (30). The battery pack (34) is electrically coupled to a battery recharger socket (72) located at the lower end of the handle (6). The battery recharger socket (72) protrudes through a small aperture (74) in the handle (6) to provide an electrical link between the battery pack (34) and an external battery-recharging source (not shown). Alternatively, the power source may be a rechargeable battery detachably fixed to the handle (6), or a mains electrical supply.

Returning to FIGS. 4 and 5, the drill head (4) has a first cylindrical hub (76) and a second cylindrical hub (78) both located part way along the length of the drill head (4), remote from the output spindle (20). The first and second hubs (76,78) are located on opposite sides of the drill head (4). The first and second hubs (76, 78) are substantially the same diameter and both arranged about axis Z. The first and second hubs (76, 78) extend from the drill head (4) in diametrically opposed directions along axis Z. Axis Z is perpendicular to axis's X and Y.

Figure 8:
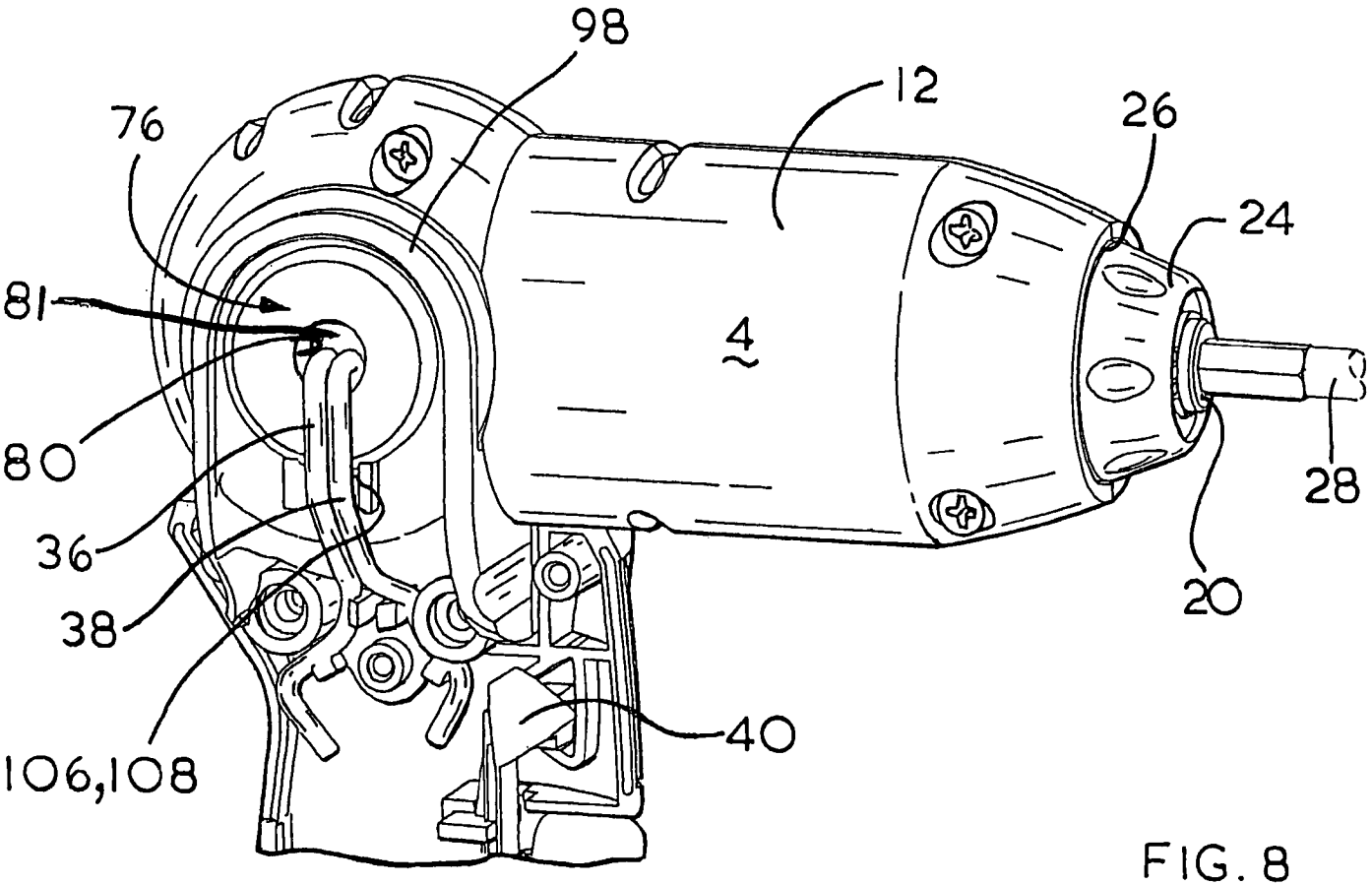
FIG. 8 shows a side cut-away view of the entry point of electrical wires into the drill head.
Figure 9:
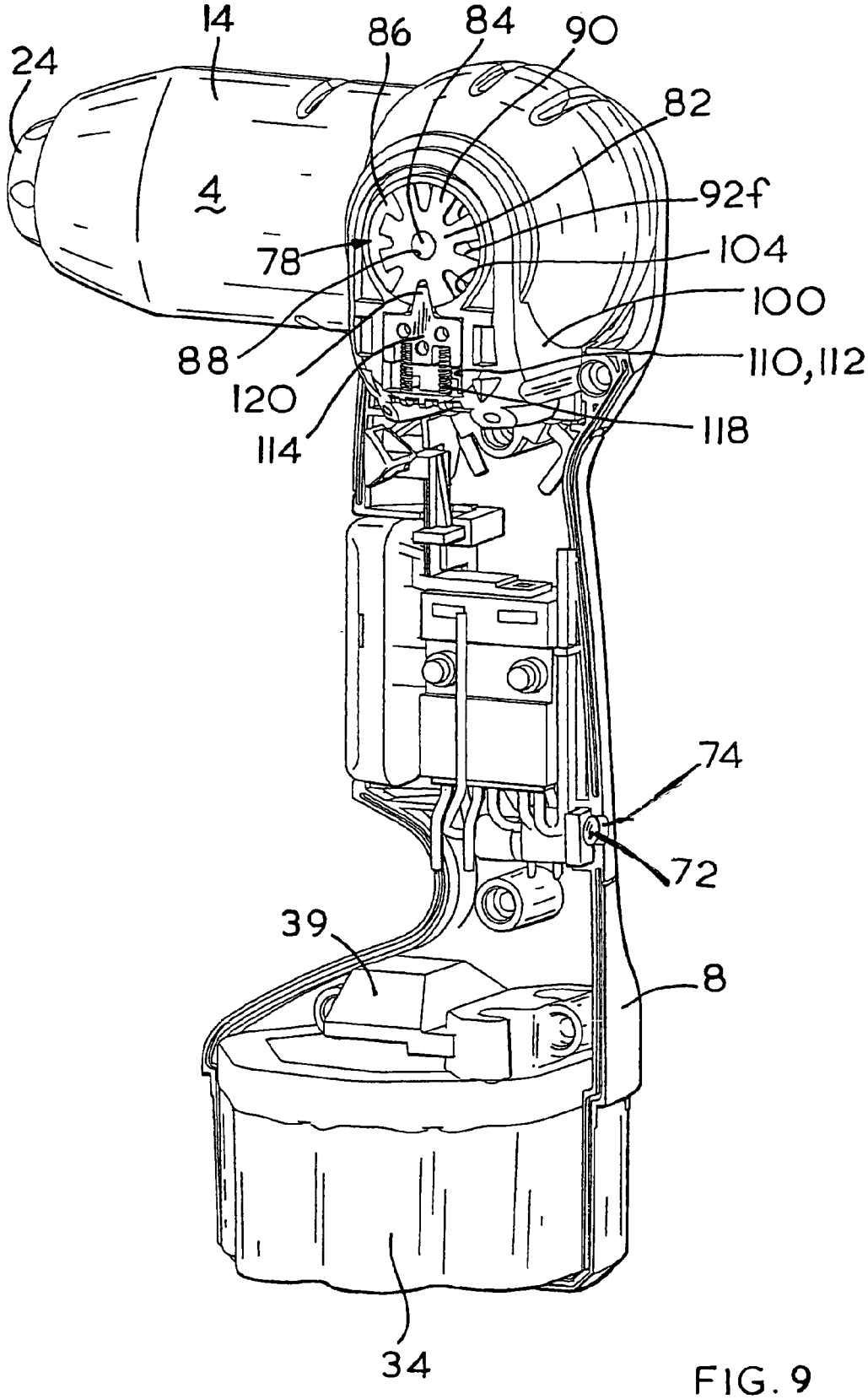
FIG. 9 shows a side cut-away view of the locking mechanism of the power tool.
Figure 10:
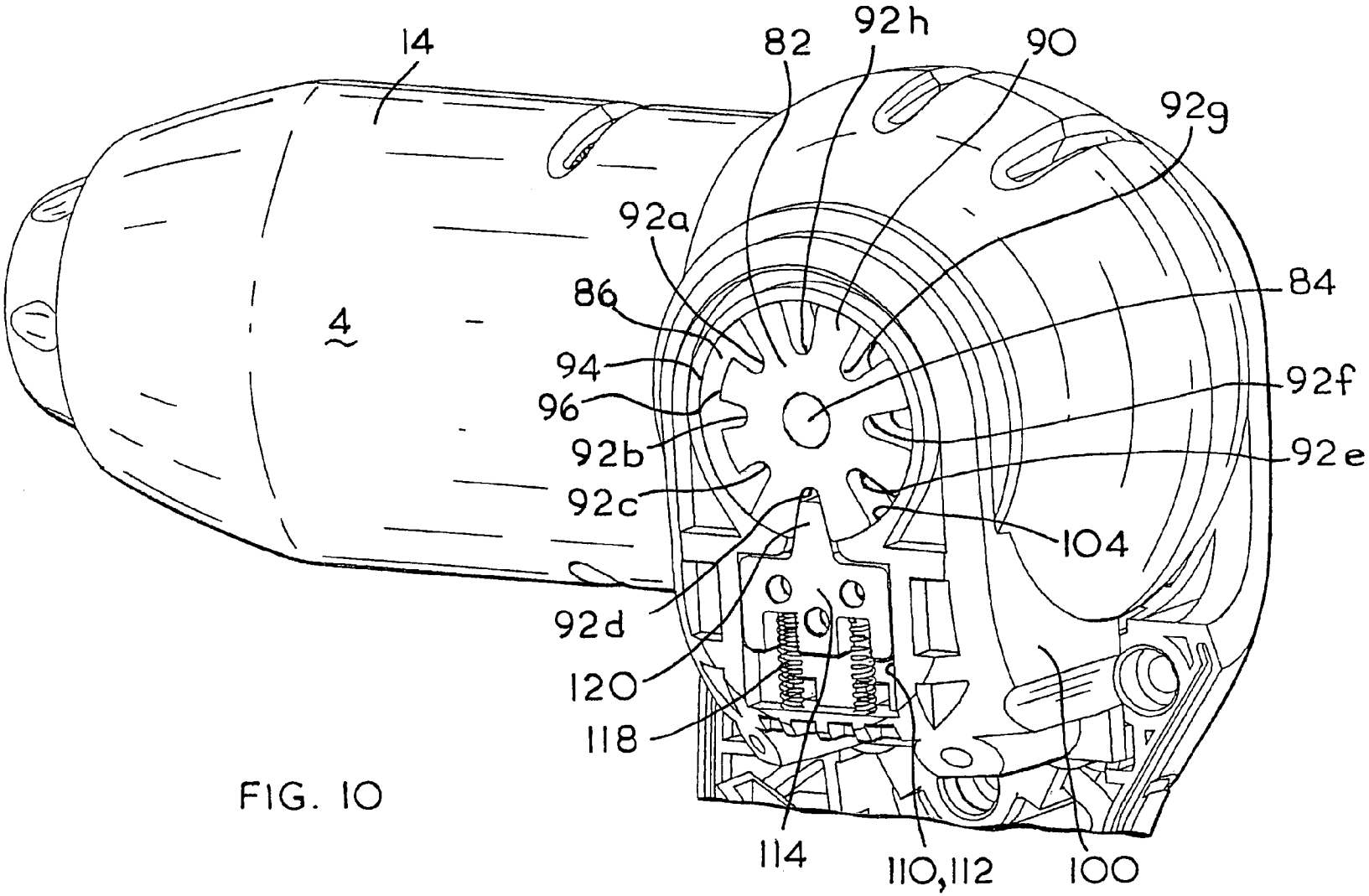
FIG. 10 shows a detailed view of the locking mechanism shown in FIG. 9.

Referring to FIG. 8, the first cylindrical hub (76) is moulded into the third clam shell (12) of the drill head (4). The first cylindrical hub (76) comprises a central inner aperture (80) co-axial with axis Z. The inner aperture (80) provides an entry point to the interior of the drill head (4). Referring to FIGS. 9 and 10, the second hub (78) comprises a circular toothed wheel (82), a protrusion (86) and, a cylindrical spigot (84) having axis Z. The protrusion (86) and the spigot (84) are moulded into the fourth clam shell (14) of the drill head (4). The wheel (82) comprises a central aperture (88) and a plurality of teeth (90) arranged equiangularly around the circumference of the wheel (82). The toothed wheel (82) has eight teeth (90) juxtaposed by eight recesses (92) for engagement with part of a locking plate, which is described in more detail below. The eight teeth (90) are arranged at 45° intervals about the axis Z. The wheel (82) is press fitted upon the fourth clam shell (14). Two of the eight teeth (90) are shorter than the outer diameter of the wheel (82). The protrusion (86) has a curved exterior face (94) and an interior face (96) shaped to surround the two short teeth (90) and engage three recesses (92*a*, 92*b*, 92*c*) adjacent the two short teeth (90) thereby preventing rotation of the wheel (82) relative to the drill head (4). The spigot (84) protrudes through the aperture (88). The outer diameter of the spigot (84) is slightly larger that the diameter of the aperture (88) such that interference fit between the spigot (84) and the circumference of the aperture (88) holds the wheel (82) upon the drill head (4). The curved exterior face (94) of the protrusion (86) and the tips of the teeth (90) collectively describe the outer circumference of the second hub (78). The wheel (82) is made of steel, Alternatively, the wheel (82) may be made of another suitable hard material.

Returning again to FIGS. 4 and 5, located at the top end of the handle (6) (opposite end to the battery pack) is a first supporting bracket (98) and a second supporting bracket (100) each shaped to nest in the interior of the first and the second clamshells (8,10) of the handle (6), respectively. The first bracket (98) has a circular aperture (102) for receiving the first hub (76). The second bracket (100) has a circular aperture (104) for receiving the second hub (76). The first and second hubs (76,78), the first and second bracket apertures (102,104), the first hub aperture (80) and the spigot (84) are co-axial having axis Z. The first and second bracket apertures (102,104) act as a yoke in which the first and second hubs (76,78) are supported for pivotal rotation relative to the handle (6). As such, the first and second bracket apertures (102,104) provide pivotal support to the first and second hubs (76,78), respectively, to allow the drill head (4) to pivot relative the handle (6) about axis Z.

Returning to FIG. 8, the first support bracket (98) has a first walled recess (106) facing the interior of the first clam shell (8) of the handle (6). A cavity (108) bounded by the walled recess (106) and the interior of the first clam shell (8) is formed there between. The cavity (108) provides a connecting passageway from the interior of the handle (6) to first hub (76) for the wires (36,38). Accordingly, the wires (36,38) travel from the switch (32) via the cavity (108) through the first hub's aperture (80), forming a gap 81, to the motor (20) inside the drill head (4).

Returning to FIGS. 9 and 10, The second support bracket (100) has a second walled recess (110) facing the interior of the first clam shell (10) of the handle (6). A space (112) bounded by the second walled recess (110) and the interior of the second clam shell (10) is formed there between. The space (112) contains a locking plate (114), a lock release button (116) fixed to the locking plate (114), and two helical springs (118). The locking plate (114) has a tongue (120) which is for locking engagement with any one of the five recesses (92*d* to 92*h*) of the toothed wheel (82) not occupied by the interior face (96) of the protrusion (86).

The locking plate (114), the lock release button (116), and the two helical springs (118) collectively form a locking mechanism for locking pivotal movement of the head (4) relative to the handle (6) about the axis Z. The tongue (120) of the locking plate (114) is biased into engagement with a recess (92) by the springs (118), thereby locking pivotal movement of the head (4) relative to the handle (6). To allow pivotal movement of the head (4) relative to the handle (6) the user disengages the tongue (120) from a recess (92) by sliding the locking plate (114) and the release button (116) against the bias of the springs (118). Sliding movement of the locking plate (114) is guided by the second walled recess (110). Access to the release button (116) for operation of the locking plate (114) is provided by a hole (122) in the top end of the second clamshell (10) of the handle (6).

Figure 11:
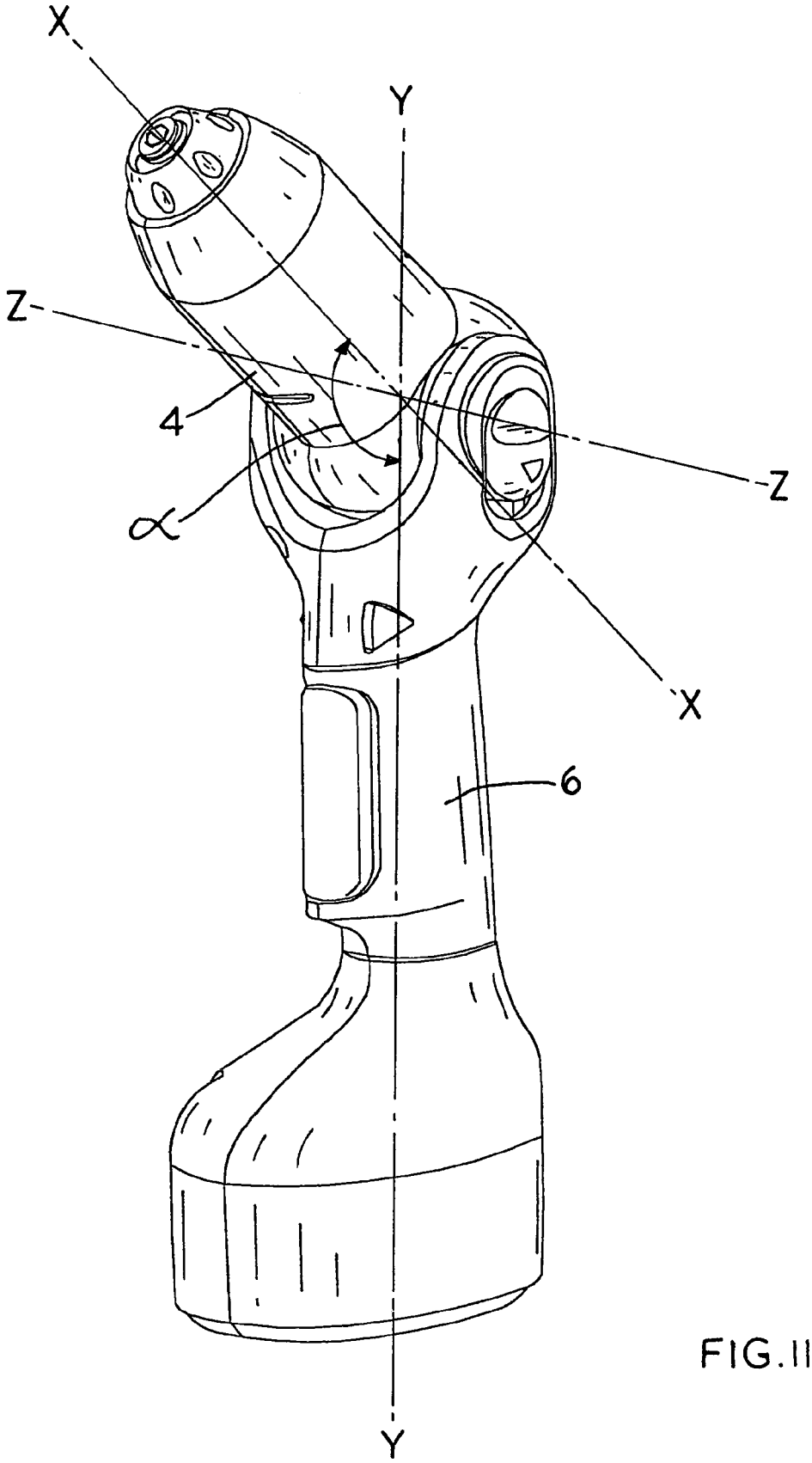
FIG. 11 shows a side perspective view of the power tool with the rotatable drill head inclined at 135° to the handle.
Figure 12:
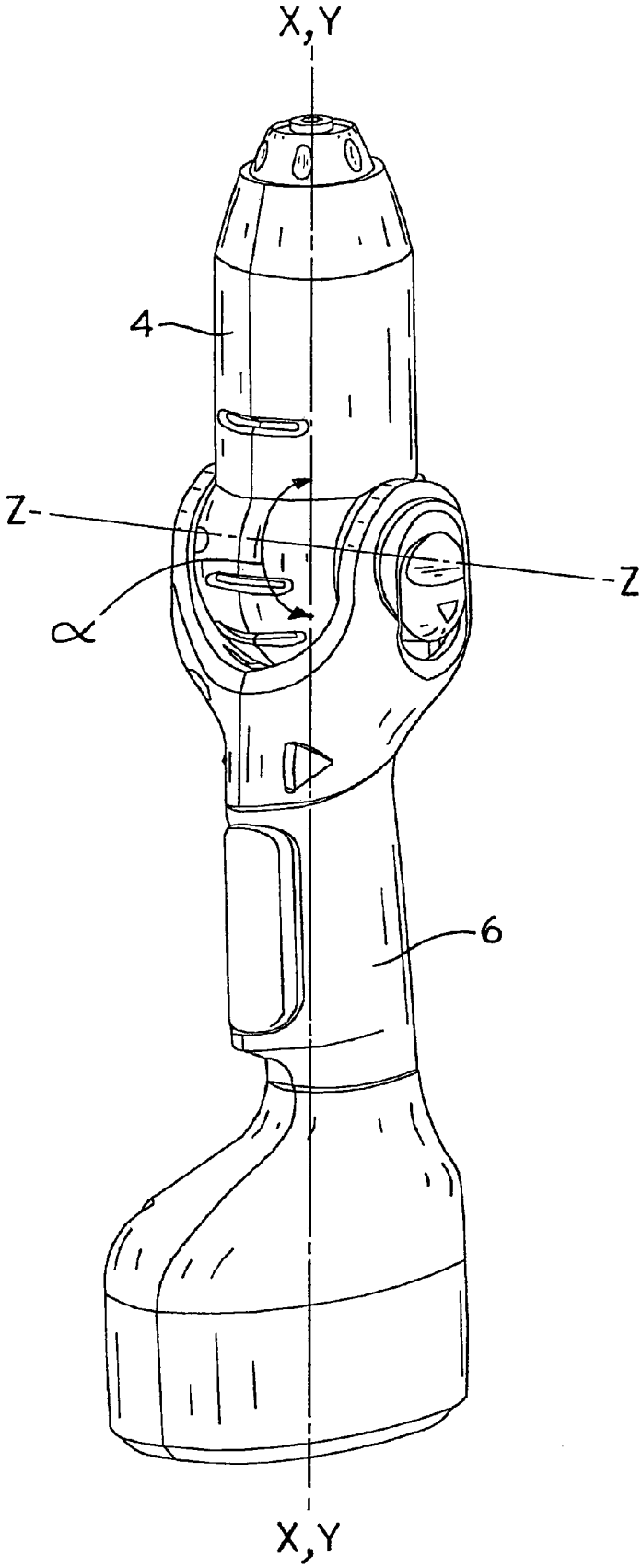
FIG. 12 shows a side perspective view of the power tool with the rotatable drill head in line with the handle.
Figure 13:
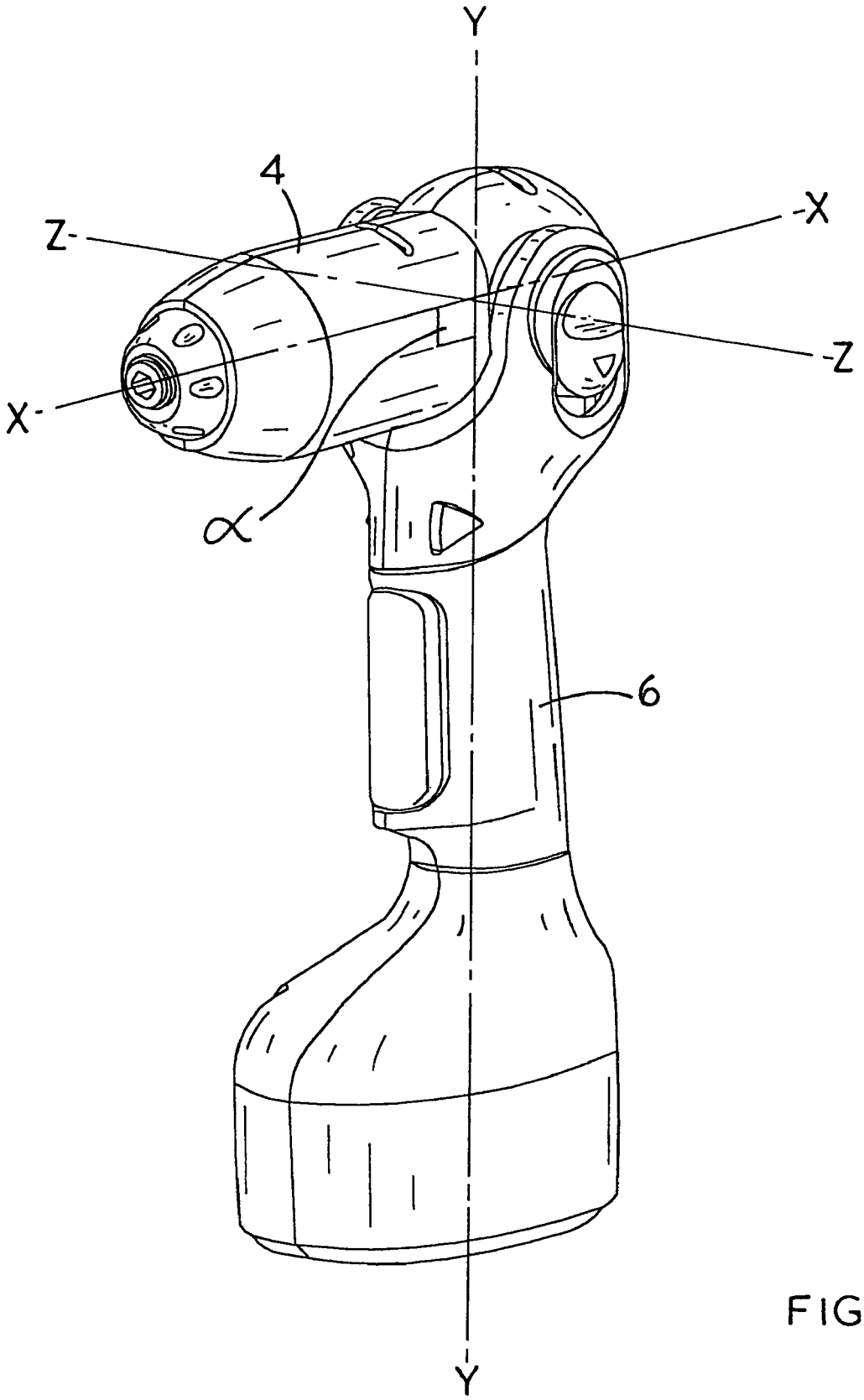
FIG. 13 shows a side perspective view of the power tool with the rotatable drill head perpendicular to the handle.

Referring now to FIGS. 10 to 13, axis Z is the axis about which the head (4) pivots with respect to the handle (6). Axis Y represents the position of the handle (6) and axis X represents the position of the drill head (4). Both axis X and Y remain perpendicular to axis Z regardless of the orientation of the drill head (4) in relation to the handle (8). The included angle between axis X and Y is referred to as angle $\alpha$ Only angle $\alpha$ varies when the drill head (4) changes its orientation in relation to the handle (8) by pivoting about the axis Z. Angle $\alpha$ is dictated by which one of the five unoccupied recesses (92*d* to 92*h*) engages the tongue (120) of the locking plate (114). Angle $\alpha$ is 90° when recess (92*d*) engages the tongue (120), as shown in FIG. 13. Recess (92*e*) is located 45° anti-clockwise from recess (92*d*), therefore angle $\alpha$ is 135° when recess (92*e*) engages the tongue (120), as shown in FIG. 11. Angle $\alpha$ is 180°, 225° and 270° when one of the three respective subsequent recesses (92*f*, 92*g*, 92*h*) engage the tongue (120).

In the illustrated embodiment of the present invention, angle $\alpha$ can be set to five positions within a range of 180°, according to which one of the five unoccupied recesses (92*d* to 92*h*) engages the locking plate (114). However the range of angle $\alpha$ can be increased from 180° by reducing the number of recesses (92) engaged by the interior face (96) of the protrusion (86) from three recesses (92*a*, 92*b*, 92*c*) to two recesses, or even only one recess. Also, the number of positions within the range of angle $\alpha$ can be varied by changing the number of recesses (92) and teeth (90), or varying the angular spacing between adjacent recesses (92) and teeth (90) around the circumference of the toothed wheel (82).

The invention claimed is:

1. A power tool comprising:

a handle defining a first axis; and a tool body defining a second axis, said tool body pivotally coupled to the handle by a pivot, said pivot defining a third axis, said first and second axes being substantially perpendicular to said third axis, and a connection aperture substantially concentric with the third axis; and an electrical connection between the handle and the tool body which passes through the pivot and through the connection aperture along said third axis.

2. A power tool as claimed in either one of claim 1, wherein the electrical connection comprises two electrical wires.

3. A power tool as claimed in claim 2, wherein a gap is formed between the two electrical wires and the connection aperture.

4. A power tool as claimed in claim 1, wherein the pivot comprises:

at least one aperture formed in one of the tool body or the handle; and at least one cylindrical hub protruding from the other of the tool body or the handle, wherein the at least one aperture is along the third axis, and wherein the at least one cylindrical hub is disposed concentrically within a respective aperture of said at least one aperture such that sliding contact between the at least one cylindrical hub and said respective aperture supports the tool head for pivotal rotation relative to the handle.

5. A power tool as claimed in claim 4, wherein the at least one aperture is formed in the handle and the at least one hub is disposed upon the tool body.

6. A power tool as claimed in claim 4, wherein the at least one aperture further comprises a first aperture and a second aperture formed in one of the said tool body or said handle, the first aperture and the second aperture each along the third axis, and wherein the at least one hub further comprises a first hub disposed concentrically within the first aperture and a second hub disposed concentrically within the second aperture.

7. A power tool in claimed in claim 6, wherein the connection aperture is in the first hub.

8. A power tool claimed in claim 1, wherein the tool body is elongate and the power tool comprises a motor coupled to a rotary output, wherein the rotary output is along the second axis.

9. A power tool as claimed in claim 8, wherein the motor is housed in the tool body.

10. A power tool as claimed in claim 9, wherein the power tool further comprises: a power source for energising the motor; and an electrical switch electrically coupled to the power source; wherein the switch is disposed upon the handle and the electrical connection carries electrical current from the switch to the motor housed in the tool body.

11. A power tool as claimed in claim 10, wherein the power source is a battery pack.

12. A power tool as claimed in claim 11, wherein the battery pack is housed within the handle.

13. A power tool as claimed in claim 11, wherein the battery pack is electrically coupled to an electrical socket disposed upon the handle, said electrical socket adapted for coupling with an external battery charging source.

14. A power tool as claimed in claim 11, wherein the battery pack is detachably connected to the handle.

15. A power tool as claimed in claim 8, wherein an arc defined by pivotal rotation of the tool body relative to the handle about the third axis subtends a pivotal angle ($\alpha$) between the second axis and the first axis, which pivotal angle ($\alpha$) can vary by more than 90°.

16. A power tool as claimed in claim 15, wherein the pivotal angle ($\alpha$) can vary by 180°.

17. A power tool as claimed in claim 15, wherein the value of the pivotal angle ($\alpha$) can vary between 90° and 270°.

18. A power tool as claimed in claim 1, wherein the power tool further comprises a locking mechanism for locking the tool body against pivotal movement relative to the handle.

* * * * *